US005687859A

United States Patent [19]

Miller

[11] Patent Number: 5,687,859

[45] Date of Patent: Nov. 18, 1997

[54] NON-RACKING PANEL DISPLAY DEVICE

[75] Inventor: Melvin M. Miller, Nashville, Ind.

[73] Assignee: Channel-KOR Systems, Inc., Bloomington, Ind.

[21] Appl. No.: 399,236

[22] Filed: Mar. 6, 1995

[51] Int. Cl.[6] ..... A47B 43/00

[52] U.S. Cl. ..... 211/189; 211/182; 52/584.1

[58] Field of Search ..... 211/189, 182; 52/584.1, 585.1, 582.1, 582.2

[56] References Cited

U.S. PATENT DOCUMENTS

| | | | |
|---|---|---|---|
| 2,647,287 | 8/1953 | Jones | 52/582.2 |
| 2,970,677 | 2/1961 | Springs | 189/34 |
| 3,087,586 | 4/1963 | Gray | 189/34 |
| 3,766,696 | 10/1973 | Totoonchie | 52/584.1 |
| 4,204,375 | 5/1980 | Goud | 52/239 |
| 4,381,632 | 5/1983 | Geitner | 52/262 |
| 4,505,085 | 3/1985 | Oliver et al. | 52/582.1 |
| 4,625,477 | 12/1986 | Johnstonbaugh | 52/582.2 |
| 4,716,692 | 1/1988 | Harper et al. | 52/36 |
| 4,778,486 | 10/1988 | Chenel | 52/239 |
| 4,926,609 | 5/1990 | Arico | 52/582.2 |
| 4,989,386 | 2/1991 | Collis | 52/584.1 |
| 5,004,371 | 4/1991 | Sorensen | 403/327 |
| 5,038,535 | 8/1991 | Van Praag | 52/127.9 |

*Primary Examiner*—Leslie A. Braun
*Assistant Examiner*—Willie Berry, Jr.
*Attorney, Agent, or Firm*—Donald R. Bahr

[57] ABSTRACT

This invention is concerned with a panel device which is useful in the display and furniture arts, the panel device is formed from a plurality of panels which are securely locked into a three axis relationship with each other, the vertical edges of the individual panels incorporate undercut grooves, the vertical edges of the individual panels are provided with opposing guide pins which generally retain the panels in relation to each other, the individual panels are further provided with opposing locking lugs and a biased lock which retain the panels in relation to each other, the panel device may be readily converted from a set up to a flat stance one on each other for storage, in one embodiment at least the vertical edges of the individual display panels are provided with undercut H shaped channels that are secured in grooves that are routed into the edges of the panels, these H shaped channels further interact with the guide pins, locking lugs and the biased lock.

18 Claims, 4 Drawing Sheets

NON-RACKING PANEL DISPLAY DEVICE

FIELD OF THE INVENTION

This invention is concerned with portable flexible, panel devices which can be used to display information at trade shows and conventions. The panel device of this invention is also useful in the furniture arts. Panel devices as may be used at trade shows or conventions are of two principle types, those being the large bulky type and the portable type. This invention is concerned with the portable type of device. Portable display devices have become very popular in recent years for utilization at regional trade shows and conventions, these portable display devices, when assembled, present a nice impression and have a very high display surface to weight ratio. Further, these portable display devices are advantageous in that they can be quickly and easily assembled and disassembled without tools by one person. In contrast, the large bulky display devices as mentioned above are very heavy and hence have a low display surface to weight ratio. Further, these display devices can be assembled and dissembled only with great difficulty by extra workmen at great expense.

DESCRIPTION OF THE BACKGROUND ART

The subject invention is useful in connection with portable display devices wherein a plurality of display panels may be combined to form a composite portable display device. Further the invention is concerned with portable displays wherein the panels may be located in angular relationship with each other. This invention is also concerned with display devices wherein the supporting structure is covered with the same fabric that is used to cover the display panels so that the total display presents a uniform surface.

Planar display devices are very common in the prior art. Typically, these prior art display devices comprise a plurality of segments which are formed from a plurality of interconnected panel sections. Because these segments are formed from interconnected panel sections the panel sections become somewhat heavy and difficult to assemble into a finished display device. The weight of the display segments is particularly important when the assembly of the finished display device must be effected by a woman. This invention is concerned with display devices wherein single panel sections are joined one to each other to form a finished multi-panel display device.

With all light weight panel devices there is a problem of holding the individual panel sections in relation to each other. This is particularly true of the joints which allow the individual components to be broken down. Naturally the more components that are used to form a display device the more problems one has in retaining these component panels in fixed relationship with each other.

Referring to FIG. 1 which shows X,Y, and Z axis the panel attachment systems of the prior art do an acceptable job of retaining the various panel segments in relation to each other in the X and Z axis. Retaining the panels in relation to each other and preventing movement in the Y axis remains a problem. The movement of panel segments in relation to each other in the Y axis is analogous to the vertical shearing of the panels one past each other.

This invention is concerned with a panel locking system where individual panels can be locked into a secure rigid relationship with each other in the X,Y, and Z axis in order to form a strong, stable display device. In accordance with this invention a display device is formed by the locking of a plurality of panels in an up and down, left to right and forward and backward relationship. This secure locking of the individual panels allows the display device to be used on uneven surfaces for example, the uneven concrete floor of a convention center.

The locking of a plurality of individual panels to form a display device in accordance with this invention can be effected without tools and with only the use of finger pressure.

Further, in this invention all the components of the display are uniformly covered with the same fabric or other sheet material.

Accordingly, it is an object of this invention to provide a panel device wherein the display panels and the supporting hardware are covered with the same fabric or other sheet material.

It is a further object of this invention to provide a system wherein a plurality of individual panels can be readily and easily assembled into a display device.

Likewise, it is an object of this invention to provide a display device which can be readily converted from a set up stance to a flat stance for shipping.

It is also an object of this invention to provide a portable display device wherein individual panels can be replaced or subtracted from the display device to allow reconfiguration of the display at will. It is also an object of this invention to provide a portable display device which allows for the easy replacement of damaged panel sections.

It is also an object of this invention to provide a means wherein a plurality of individual panels can be locked into a secure three axis relationship with each other to form a display device without the use of tools and can be unlocked for easy disassembly with only the use of finger pressure.

Another object of this invention is to provide a display device wherein the individual panels do not rack one past another in a vertical plane.

Still another object of this invention is to provide a display device which can be used on an uneven surface.

Also, it is an object of this invention to provide a display device which can be assembled from individual panels by a person of small stature for example a woman.

These objects and advantages should be construed as merely illustrative of some of the more prominent features and applications of the present invention. Many other beneficial results can be obtained by applying the disclosed invention in a different manner or by modifying the invention within the scope of the disclosure. Accordingly, other objects and advantages as well as a fuller understanding of this invention may be had by referring to the summary and detailed description of the preferred embodiment of the invention in addition to the scope of the invention as defined by the claims taken in conjunction with the accompanying drawings.

SUMMARY OF THE INVENTION

The invention is defined by the appended claims with the specific embodiments shown in the attached drawings. For the purposes of summarizing the invention, the invention may be described as a system where a plurality of individual panels can be readily and easily assembled into a multi-panel display device.

This invention provides a means wherein the individual panels can be rigidly secured one to another in a three axis relationship.

The invention utilizes a plurality of panels having vertical edges which incorporate undercut channels. These undercut channels are further provided with opposing guide fingers which assist in locating and securing a pair of opposing panels in X and Z planes, as is illustrated in FIG. 1.

The vertical edges of the panels are further provided with a pair of locking lugs which interact with the terminal ends of the panels to further secure the panels in relation to each other.

One edge, preferably the upper edge of one of the panels is further provided with a biased locking means that interacts with an opposing panel so as to further secure a pair of panels in a vertical relationship with each other. When the biased locking means is disengaged the opposing panels can be disassembled.

When a plurality of individual panels are assembled together a display device results. Multiple tiers of assembled panel segments can be placed one on another to form a composite display device.

Because the panel device of this invention is formed from a plurality of individual panel sections it can be readily converted from a set up stance to a planar stance. The ability to convert panels form a set up stance to a planar stance is very useful, as in the planar stance the panel can be readily stored for shipment.

The foregoing has outlined rather broadly the more pertinent and important features of the present invention in order that the detailed description of the invention that follows may be better understood whereby the present contribution to the art may be more fully appreciated. Additional features of the invention will be described hereinafter which form the subject of the claims of the present invention. It should be appreciated by those skilled in the art, that the conception and the specific embodiment disclosed herein may be readily utilized as a basis for modifying or designing other display devices for carrying out the purposes of the present invention. Further it should also be realized by those skilled in the art that such equivalent display devices do not depart from the spirit and scope of the invention as set forth in the appended claims.

DESCRIPTION OF THE PREFERRED EMBODIMENT

The subject invention relates to a panel device which is formed from a plurality of panels which are secured in relationship to each other.

Figure 1:
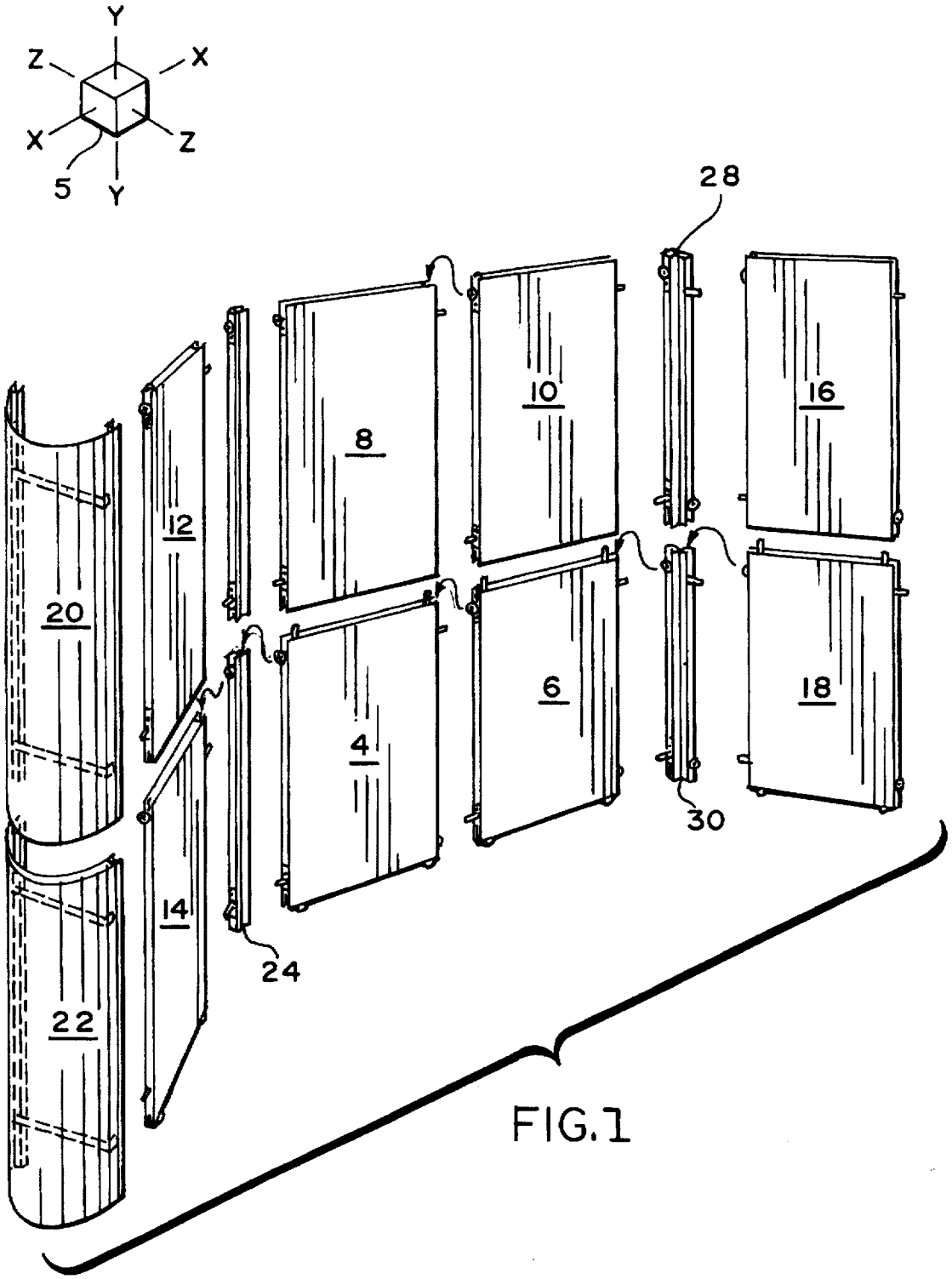
FIG. 1 is a perspective view showing a display device of this invention showing the individual components thereof.

Referring to FIG. 1 it can be seen that the panel device 2 of this invention comprises a plurality of planar panels 4,6,8,10,12,14,16 and 18 which are interconnected. The interconnecting of panels 8 to 12, 4 to 14, 10 to 16 and 6 to 18 is via a hinge members 24,26,28 and 30 also shown. FIG. 1 also shows the connection of curved panels 20 and 22 to planar panels 12 and 14.

FIG. 1 also incorporates an X,Y and Z axis legend 5 which comprises a reference for the discussion herein. The X axis is the horizontal axis which which is parallel to the plane of panels 4,6,8 and 10. The Y axis is the vertical axis which is parallel with the plane of panels 4,6,8 and 10. Lastly the Z axis is the axis which is at right angles to the plane of panels 4,6,8 and 10. That is the X axis is left to right, the Y axis is up and down and the Z axis is in and out.

This invention is particularly concerned with preventing the individual panels from racking one past another in the Y axis. This racking could also be described as a vertical shear of one panel past another.

The prevention of the racking of one panel past another is undesirable as when one panel racks past another the overall display device presents a distorted surface which is undesirable in both the furniture and display arts.

As is mentioned hereinabove, the subject device is particularly useful in the portable display arts. It should be noted, however, that the panel device of this invention is also useful in the furniture arts. The subject panel device can be fabricated in such a size that it can be used for example, as a room divider, office separator, privacy screen or noise barrier. In the furniture arts, the panel device of this invention is particularly useful in that the various panels can be angularly disposed in relation to each other.

Figure 2:
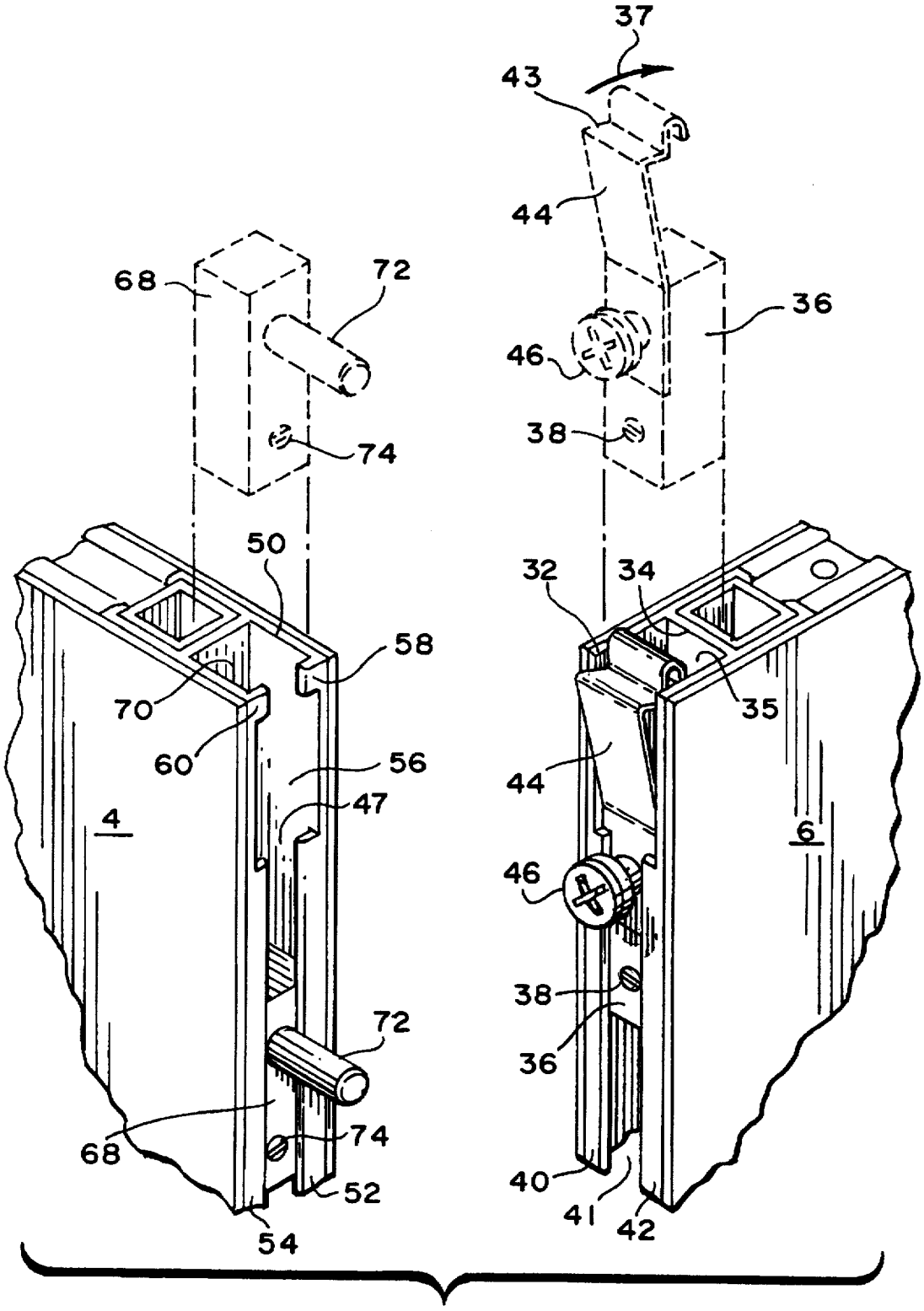
FIG. 2 is a fragmentary perspective view, partly in section, of an upper segment of a display panel of this invention showing the assembly of the parts thereof some parts being shown in phantom lines.
Figure 3:
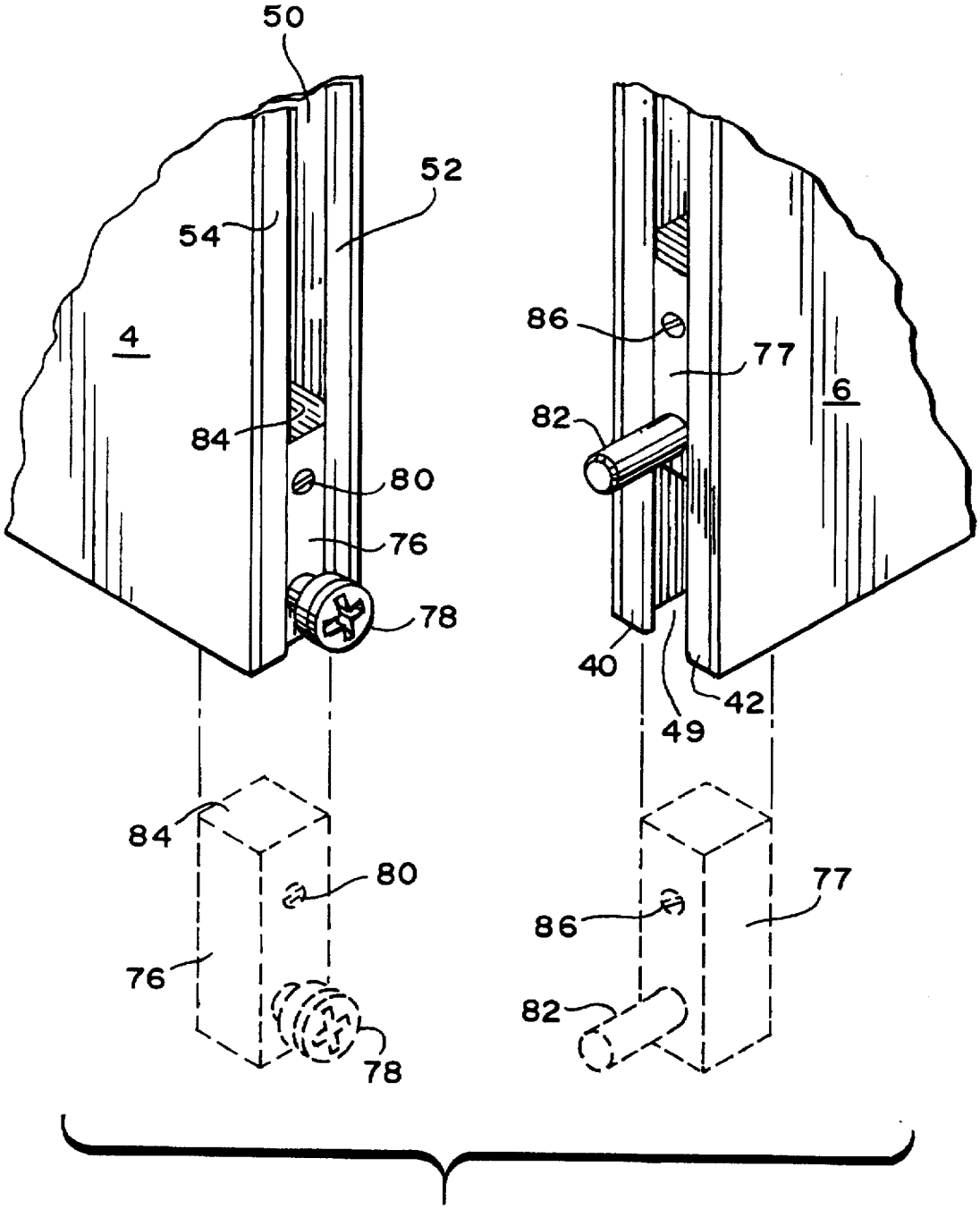
FIG. 3 is a fragmentary perspective, partially in section, of a lower segment of a display panel of this invention showing the assembly of the parts thereof some parts being shown in phantom lines.

The details of how vertical panels 4 and 6 are joined together is shown in FIGS. 2 and 3. For purposes of description panels 4 and 6 are taken as representative adjacent panels out of FIG. 1, Further the hinge members 24,26,28 and 30 and the curved panels 20 and 22 are interconnected to planar panels in the same manner as is described in connection with panels 4 and 6 as is illustrated in FIGS. 2 and 3.

Referring to FIG. 2 it can be seen that panel 6 has an H shaped extrusion 34 integral therewith, a locking block 36 is positioned in the outer compartment 35 of H extrusion 34. Locking block 36 is retained in H extrusion 34 by screw 38 which biases locking block 36 against lips 40 and 42 of H shaped extrusion 34. Locking block 36 further incorporates a leaf spring lock 44 and a locking lug 46 the function of which will be described in detail herein below.

Panel 4 also has an H shaped extrusion 50 intregal therewith. The outer compartment 70 of H shaped extrusion 50 further incorporated a pair of opposing lips 52 and 54. Lips 52 and 54 are relieved to form aperture 56. As a result of the formation of aperture 56 locking tabs 58 and 60 are formed.

Guide pin block 68 is positioned in outer compartment 70 of H shaped extrusion 50. Guide pin block 68 incorporates a guide pin 72 and a locking screw 74. Guide pin block 68 is retained in compartment 70 by using locking screw 74 to bias guide pin block 68 against the inner edges of lips 52 and 54. Guide pin block is positioned in compartment 70 intermediate of the terminal ends of H shaped extrusion 50.

As is shown in FIG. 3 the lower side of panel 4 incorporates locking lug block 76 which has as an integral part thereof locking lug 78 and locking screw 80.

Locking lug block 76 is secured in compartment 70 near the lower terminal end of H shaped extrusion 50 by locking screw 80 which biases the edges of locking lug block 76 against lips 52 and 54 of H shaped extrusion 50.

Positioned near the lower edge of panel 6 is guide pin block 77 which is retained in compartment 50 of H shaped extrusion 34 by locking screw 86 which biases locking pin block 77 against lips 40 and 42 of H shaped extrusion 34. Guide pin block 77 may be positioned in compartment 50 of H shaped extrusion 34 at a position such that guide pin 82 is biased against the upper edge 84 of locking lug block 76 of adjacent panel 4. This positioning of guide pin 82 against upper edge 84 of locking lug block 76 functions as a downward stop for panel 6 in relation to panel 4, thereby causing the upper and lower edges of panels 4 and 6 to register perfectly with each other.

In assembly panels 4 and 6 are positioned roughly in a planar relationship with each other, panel 6 being slightly above panel 4. Locking lug 46 is then positioned in apeture 56. Guide pin 72 is positioned in compartment 35 via slit 41. On the lower side of panels 4 and 5 guide pin 82 is positioned in compartment 50 via slit 51, and locking lug 78 is positioned in the lower terminal end of compartment 35.

When this positioning is effected panels 4 and 6 may be joined via the following described sequence, panel 6 is moved downwardly in relation to panel 4 thereby causing locking lug 46 to be secured in groove 47 and biased against lips 52 and 54. In turn locking lug 78 moves up into groove 49 and is biased against lips 40 and 42.

The downward movement of panel 6 in relation to panel 4 is controlled by guide pin 82 which is ultimately biased against upper edge 84 of locking block 76.

When this positioning is complete spring 44 is biased into apeture 56 whereupon lip 43 of spring 44 is secured against locking tabs 58 and 60 in order to disengage panel 4 from panel 6 and hence disassemble the display device, pressure is applied to spring tab 35 in the direction of arrow 37 such that lip 43 disengages locking tabs 58 and 60 thereby permitting panel 6 to be lifted up in relation to panel 4, thereby causing the disengagement of panel 6 from panel 4.

Figure 4:
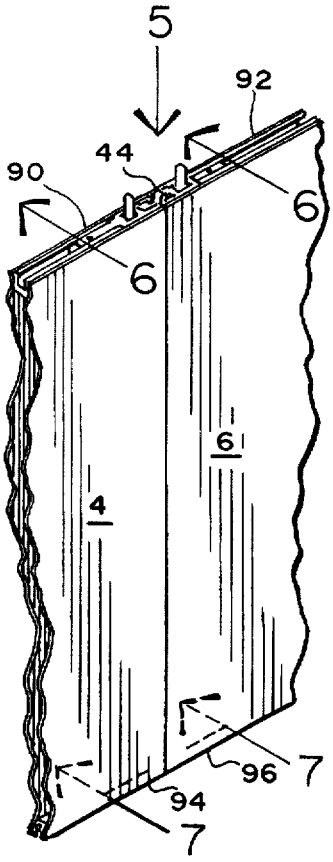
FIG. 4 is a sectional side view showing two display panels in abutting relationship.

FIG. 4 illustrates a pair of adjacent panels 4 and 6 which are secured in relationship to each other in accordance with this invention. It should be noted that adjacent pairs of edges 90 and 92, and 94 and 96 are in perfect registry with each other.

Figure 5:
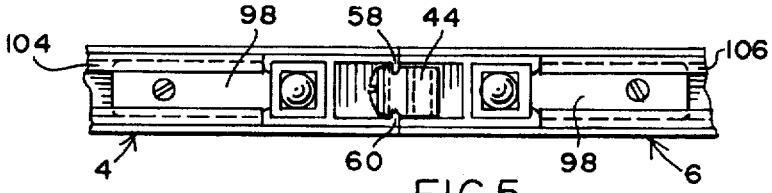
FIG. 5 is a top view of the center of the structure of FIG. 4.

FIG. 5 shows from a top view the joining of adjacent panels 4 and 6.

Figure 6:
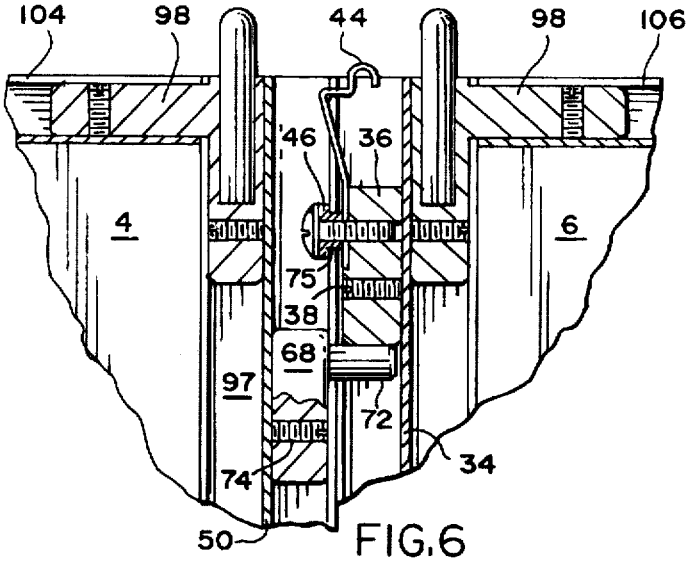
FIG. 6 is a sectional view through line 6—6 of FIG. 4.

FIG. 6 is a cut away side view showing the top side relationship of the various components of this invention when adjacent panels 4 and 6 are joined together.

Figure 7:
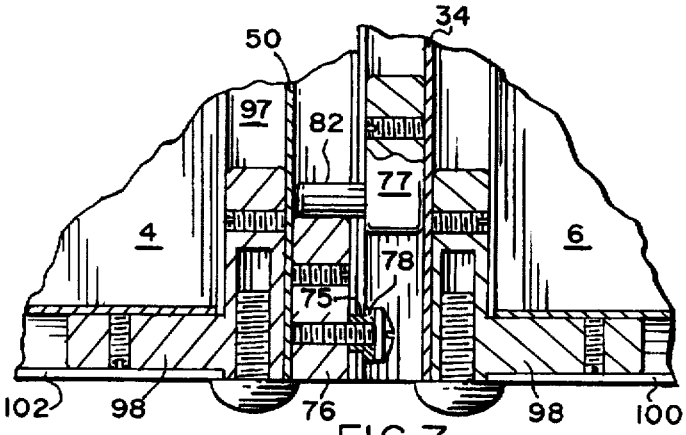
FIG. 7 is a sectional view through line 7—7 of FIG. 4.

FIG. 7 is a cut away side view showing the bottom side relationship of the various components of this invention when adjacent panels 4 and 6 are joined together.

FIGS. 5, 6, and 7 further show how display panels 4 and 6 may be pictured framed by the use of four right angle connectors 98 to interconnect horizontal frame extrusions 100,102,104 and 106 with vertical H shaped extrusions 34 and 50. As is illustrated in FIG. 6 right angle connectors 98 are positioned in and secured in inner compartment 97 of H shaped extrusion 50.

As can be seen from an examination of FIGS. 2, 3, 6 and 7 locking lugs 46 and 78 are held in place by a screw. Other equivalent fasteners may likewise be used. The outer extremity of the locking lugs as illustrated are of larger diameter as compared to the body portion 75 thereof. As is best illustrated in FIG. 7 this structure forms an undercut which allows the locking lugs to be securely biased in the opposing H shaped channel thereby securing opposing display panels 4 and 6 together.

The above description and drawings are illustrative of only single modification could be made without departing from the present invention, the scope of which is to be limited only by the following claims.

What is claimed is:

1. A panel display device having a plurality of vertical display panels, with one or more pairs of adjacent vertical panels being attached to each other by a non-racking attachment system which comprises;

a. at least two guide pins which are integral with the vertical edge of one or more adjacent panels said guide pins guiding said adjacent panels into an abutting relationship with each other;

b. means for receiving said guide pins which are integral with the vertical edge of the display panel which is opposite said guide pins;

c. at least two male locking lugs which are located on the vertical edge of one or more display panels approximate the vertical terminal ends thereof;

d. female apertures which are located on the vertical edge of the display panel opposite said male locking lugs and approximate the vertical terminal ends thereof; and e. one of said vertical terminal edges having a resilient biased lock for securing said male locking lugs into said female apertures so that adjacent vertical panels may not move relative to each other without releasing the lock.

2. The panel display device of claim 1 wherein the vertical edges of adjacent pairs of vertical display panels incorporate channels in which are located said guide pins, male locking lugs female apertures and said biased lock.

3. The panel display device of claim 2 wherein said channel comprises an H shaped channel the outer edges of which incorporate a pair of opposing lips which define compartments.

4. The panel display device of claim 3 wherein said guide pins and said male locking lugs are positioned on blocks which are secured in the defined compartments of said H shaped channels.

5. The panel display device of claim 4 wherein the end of said male locking lug defines an undercut which is adapted to engage the opposing channel.

6. The panel display device of claim 2 wherein the end of said male locking lug defines an undercut which is adapted to engage the opposing channel.

7. The panel device of claim 2 wherein said guide pins and said male locking lugs are integral with bases which are secured in channels which in turn are secured to opposing vertical edges of said display panels.

8. The panel device of claim 7 wherein said biased lock comprises a leaf spring which is attached to the uppermost base to which is attached a male locking lug, the upper terminal edge of said leaf spring comprising an approximate right angle bend which defines a lip which is adapted to engage an apeture which is integral with the channel which is attached to the vertical edge of an adjacent vertical display panel.

9. The panel display device of claim 3 wherein the end of said male locking lug defines an undercut which is adapted to engage the opposing channel.

10. The panel device of claim 3 wherein said guide pins and said male locking lugs are integral with bases which are secured in channels which in turn are secured to opposing vertical edges of said display panels.

11. The panel device of claim 10 wherein said biased lock comprises a leaf spring which is attached to the uppermost base to which is attached a male locking lug, the upper terminal edge of said leaf spring comprising an approximate right angle bend which defines a lip which is adapted to engage an apeture which is integral with the channel which is attached to the vertical edge of an adjacent vertical display panel.

12. The panel device of claim 4 wherein said guide pins and said male locking lugs are integral with bases which are secured in channels which in turn are secured to opposing vertical edges of said display panels.

13. The panel device of claim 12 wherein said biased lock comprises a leaf spring which is attached to the uppermost base to which is attached a male locking lug, the upper terminal edge of said leaf spring comprising an approximate right angle bend which defines a lip which is adapted to engage an apeture which is integral with the channel which is attached to the vertical edge of an adjacent vertical display panel.

14. The panel display device of claim 1 wherein the end of said male locking lug defines an undercut which is adapted to engage the opposing channel.

15. The panel device of claim 5 wherein said guide pins and said male locking lugs are integral with bases which are secured in channels which in turn are secured to opposing vertical edges of said display panels.

16. The panel device of claim 15 wherein said biased lock comprises a leaf spring which is attached to the uppermost base to which is attached a male locking lug, the upper terminal edge of said leaf spring comprising an approximate right angle bend which defines a lip which is adapted to engage an apeture which is integral with the channel which is attached to the vertical edge of an adjacent vertical display panel.

17. The panel device of claim 1 wherein said guide pins and said male locking lugs are integral with bases which are secured in channels which in turn are secured to opposing vertical edges of said display panels.

18. The panel device of claim 17 wherein said biased lock comprises a leaf spring which is attached to the uppermost base to which is attached a male locking lug, the upper terminal edge of said leaf spring comprising an approximate right angle bend which defines a lip which is adapted to engage an apeture which is integral with the channel which is attached to the vertical edge of an adjacent a vertical display panel.

* * * * *